US011129469B2

(12) United States Patent
Lin

(10) Patent No.: US 11,129,469 B2
(45) Date of Patent: Sep. 28, 2021

(54) COLLAPSIBLE BRACE MEMBER FOR A FURNITURE SUPPORT STRUCTURE

(71) Applicant: Dongguan Shichang Metals Factory Ltd., DongGuan (CN)

(72) Inventor: Chen-Kang Lin, DongGuan (CN)

(73) Assignee: DongGuan Shichang Metals Factory Ltd., DongGuan (CN)

( * ) Notice: Subject to any disclaimer, the term of this patent is extended or adjusted under 35 U.S.C. 154(b) by 0 days.

(21) Appl. No.: 15/947,034

(22) Filed: Apr. 6, 2018

(65) Prior Publication Data

US 2019/0281972 A1 Sep. 19, 2019

Related U.S. Application Data

(60) Provisional application No. 62/644,617, filed on Mar. 19, 2018.

(30) Foreign Application Priority Data

Mar. 20, 2018 (CN) ..... 201810229732.6

(51) Int. Cl.
*A47B 3/091* (2006.01)
*A47B 3/08* (2006.01)

(52) U.S. Cl.
CPC ..... *A47B 3/0912* (2013.01); *A47B 3/0815* (2013.01); *A47B 2003/0824* (2013.01); *A47B 2003/0827* (2013.01)

(58) Field of Classification Search
CPC ..... A47B 3/0912; A47B 3/0815; A47B 2003/0824; A47B 2003/0827
(Continued)

(56) References Cited

U.S. PATENT DOCUMENTS 992,915 A * 5/1911 Shaw
1,236,900 A * 8/1917 Bilton ..... A47B 3/0912 108/132
(Continued)

FOREIGN PATENT DOCUMENTS

JP 2959716 B1 10/1999
KR 100746965 B1 8/2007
(Continued)

OTHER PUBLICATIONS

European Search Report for EP App. No. 19163370.0, dated Jul. 22, 2019, 11 pages.

*Primary Examiner* — Daniel J Troy
*Assistant Examiner* — Timothy M Ayres
(74) *Attorney, Agent, or Firm* — Luedeka Neely Group, P.C.

(57) ABSTRACT

A folding leg assembly including a first brace member secured to a first leg and a second brace member secured to a second leg. Each brace member includes an upper portion secured to the respective leg, a lower portion secured adjacent the bottom of the furniture support structure, to and a pivot member for connecting the upper portion to the lower portion such that each brace member is movable between an extended position and a collapsed position. A handle is disposed between the first brace member and the second brace member and is configured to assist in manipulating the pivot members of the first and second brace members between the extended position and the collapsed position.

10 Claims, 6 Drawing Sheets

(58) Field of Classification Search
USPC ..... 108/132–135
See application file for complete search history.

(56) References Cited

U.S. PATENT DOCUMENTS

| | | | | | |
|---|---|---|---|---|---|
| 1,460,216 | A * | 6/1923 | Smith | A47B 3/02 | 108/34 |
| 1,523,960 | A * | 1/1925 | Mortimer | A47B 3/0912 | 108/127 |
| 1,778,124 | A * | 10/1930 | Sauer | A47B 3/0916 | 108/132 |
| 1,944,099 | A * | 1/1934 | Mearkle | E06C 1/393 | 182/176 |
| 2,665,181 | A * | 1/1954 | Pucci | A47B 3/0912 | 108/131 |
| 2,689,158 | A * | 9/1954 | Mahr | A47B 3/00 | 108/131 |
| 2,715,558 | A * | 8/1955 | Lander | A47B 3/087 | 108/35 |
| 2,882,109 | A * | 4/1959 | Eves | A47B 3/0912 | 108/132 |
| 3,028,205 | A | 4/1962 | Harold | | |
| 3,119,641 | A * | 1/1964 | Rand | A47B 3/0912 | 312/140.2 |
| 3,357,729 | A * | 12/1967 | Krueger | A47B 3/0912 | 108/130 |
| 3,878,797 | A * | 4/1975 | Patterson | A47B 3/083 | 108/90 |
| 5,314,231 | A * | 5/1994 | Otterbacher | A47B 3/14 | 108/131 |
| 5,315,935 | A * | 5/1994 | Weisenfels | A47B 3/10 | 108/115 |
| 5,390,610 | A | 2/1995 | Gutgsell | | |
| 5,584,254 | A * | 12/1996 | Williams | A47B 3/02 | 108/118 |
| 5,865,128 | A * | 2/1999 | Tarnay | A47B 3/0912 | 108/131 |
| 6,109,687 | A | 8/2000 | Nye et al. | | |
| 6,173,660 | B1 | 1/2001 | Emmert | | |
| 6,343,834 | B1 * | 2/2002 | Wurmlinger | A47C 9/06 | 108/134 |
| 7,685,750 | B2 * | 3/2010 | Voitchovsky | D06F 81/02 | 108/122 |
| 7,849,967 | B2 * | 12/2010 | Gibson | E06C 1/393 | 182/165 |
| 8,186,481 | B2 * | 5/2012 | Moss | E06C 1/18 | 182/129 |
| 8,555,791 | B2 | 10/2013 | Jin et al. | | |
| 9,175,921 | B2 * | 11/2015 | Hughes | F41A 23/16 | |
| 9,534,443 | B1 * | 1/2017 | Bogart | E06C 1/39 | |
| 2009/0199746 | A1 * | 8/2009 | Horton | A47B 3/00 | 108/129 |
| 2017/0340100 | A1 * | 11/2017 | Tsai | A47B 3/14 | |

FOREIGN PATENT DOCUMENTS

| | | | |
|---|---|---|---|
| KR | 20110000488 | A | 1/2011 |
| WO | 2012149061 | A1 | 11/2012 |

* cited by examiner

COLLAPSIBLE BRACE MEMBER FOR A FURNITURE SUPPORT STRUCTURE

RELATED APPLICATIONS

This application claims priority to U.S. provisional patent application Ser. No. 62/644,617, filed Mar. 19, 2018, titled "Collapsible Brace Member for a Furniture Support Structure," the entire disclosure of which is incorporated herein by reference.

FIELD

This disclosure relates to a collapsible furniture support structure. More particularly, this disclosure relates to a collapsible brace members having a handle for manipulating the brace members between an extended position and a collapsed position.

BACKGROUND

Conventional folding leg assemblies for furniture support structures such as tables and benches often include brace members. One end of the brace member is typically connected to the bottom of the support structure while the opposite end of the brace member is connected to one or more legs. When the brace member is in an extended position, the one or more legs connected to the brace member are in a use position (i.e., the legs are supporting the support structure at a particular height above the ground). When the brace members are in a collapsed position, the legs are in a folded position typically disposed along the bottom surface of the support structure for storing and/or transporting the support structure.

One problem associated with conventional brace members is that it is often difficult for a user to manipulate the brace members between the extended position and the collapsed position. Another problem is that the support structure, particularly larger/longer support structures, may be difficult to carry in the folded position.

What is needed therefore is a folding leg assembly having brace members that are easily manipulated between the extended position and the collapsed position as well as a system for assisting in carrying the support structure when the brace members are in the collapsed position.

SUMMARY

The present disclosure provides a folding leg assembly having a first leg and a second leg attached to one or more axles rotatably secured adjacent a bottom of a furniture support structure. A first brace member is secured to the first leg and a second brace member is secured to the second leg. Each brace member includes an upper portion secured to the respective leg, a lower portion secured adjacent the bottom of the furniture support structure, and a pivot member for connecting the upper portion to the lower portion such that each brace member is movable between an extended position and a collapsed position. A handle is disposed between the first brace member and the second brace member that is dimensioned and configured for assisting in manipulating the pivot members of the first and second brace members between the extended position and the collapsed position. The first and second legs are in a use position when the first and second brace members are in the extended position and the first and second legs are in a folded position when the first and second brace members are in the collapsed position.

According to certain embodiments, the folding leg assembly includes a spring attached to the upper and lower portions of each of the first and second brace members for biasing the respective brace member to the extended position. In some embodiments, the upper and lower portions of each of the first and second brace members define a recess adjacent the pivot member, and the springs or other extendable mechanisms are disposed within the recesses.

According to certain embodiments, the folding leg assembly includes one or more clips secured adjacent the bottom of the furniture support structure for receiving the first and second legs in the folded position. In some embodiments, the first and second legs include a support member connecting the legs together, and at least one of the one or more clips is positioned to receive the support member when the first and second legs are in the folded position.

According to certain embodiments, the handle includes a cross member having a first end secured to the first brace member and a second end secured to the second brace member. According to some embodiments, the handle further includes a handle portion extending from the cross member in a direction opposite the first and second legs when the first and second brace members are in the extended position. In some embodiments, the handle portion is dimensioned and configured to extend substantially perpendicular from the bottom of the support structure when the first and second brace members are in the collapsed position.

According to another embodiment of the disclosure, a collapsible furniture support structure includes a supporting structure including a top surface, a bottom surface opposite the top surface, a first end, and a second end opposite the first end. A first folding leg assembly is secured to the bottom surface of the supporting structure adjacent the first end and includes a first leg having a top end portion and a second leg having a top end portion, each of the top end portions of the first and second legs secured to an axle rotatably secured to the bottom surface of the supporting structure adjacent the first end. The first folding leg assembly further includes a first brace member secured to the first leg and a second brace member secured to the second leg, the first and second brace members each including an upper portion secured to the first and second legs respectively, a lower portion secured adjacent the bottom surface of the furniture support structure, and a pivot member for connecting the upper portion to the lower portion. A first handle is disposed between the first brace member and the second brace member that is dimensioned and configured for assisting in manipulating the pivot members of the first and second brace members between an extended position and a collapsed position. The support structure further includes a second folding leg assembly secured to the bottom surface of the supporting structure adjacent the second end. The second folding leg assembly includes a third leg having a top end portion and a fourth leg having a top end portion, each of the top end portions of the third and fourth legs secured to an axle rotatably secured to the bottom surface of the supporting structure adjacent the second end. The second folding leg assembly further includes a third brace member secured to the third leg and a fourth brace member secured to the fourth leg, the third and fourth brace members each including an upper portion secured to the third and fourth legs respectively, a lower portion secured adjacent the bottom surface of the furniture support structure, and a pivot member for connecting the upper portion to the lower portion. A second handle is disposed between the third brace member and the fourth brace member that is dimensioned and configured for assisting in manipulating the pivot members of the third and fourth brace members between an extended position and a collapsed position.

According to certain embodiments, the supporting structure includes an elongated top surface. In some embodiments, the collapsible furniture support structure is a bench.

According to certain embodiments, the collapsible furniture support structure further includes a spring attached to the upper and lower portions of each of the first, second, third, and fourth brace members for biasing the respective brace member to the extended position. In some embodiments, the upper and lower portions of each of the first, second, third, and fourth brace members define a recess adjacent the pivot member, and the springs or other extendable mechanisms are disposed within the recesses.

According to certain embodiments, the collapsible furniture support structure further includes one or more clips secured adjacent the bottom surface of the supporting structure for receiving the first, second, third, and fourth legs in a folded position when the first, second, third, and fourth brace members are in their collapsed positions. According to some embodiments, the first and second legs include a first support member connecting the first and second legs together and the third and fourth legs include a second support member connecting the third and fourth legs together, and the support structure further includes at least a first clip positioned adjacent the bottom surface of the supporting structure to receive the first support member when the first and second legs are in the folded position and a second clip positioned adjacent the bottom surface of the supporting structure to receive the second support member when the third and fourth legs are in the folded position.

According to certain embodiments, each of the first and second handle includes a cross member having a first side secured to the first and third brace members respectively and a second side secured to the second and fourth brace members respectively. According to some embodiments, each of the first and second handle further includes a handle portion extending from the cross member in a direction opposite the legs of their respective folding leg assembly when the first, second, third, and fourth brace members are in the extended position. In some embodiments, the handle portion is dimensioned and configured to extend substantially perpendicular from the bottom of the support structure when the first, second, third, and fourth brace members are in the collapsed position.

BRIEF DESCRIPTION OF THE DRAWINGS

Further advantages of the disclosure are apparent by reference to the detailed description when considered in conjunction with the figures, which are not to scale so as to more clearly show the details, wherein like reference numbers indicate like elements throughout the several views, and wherein.

DETAILED DESCRIPTION

Figure 1:
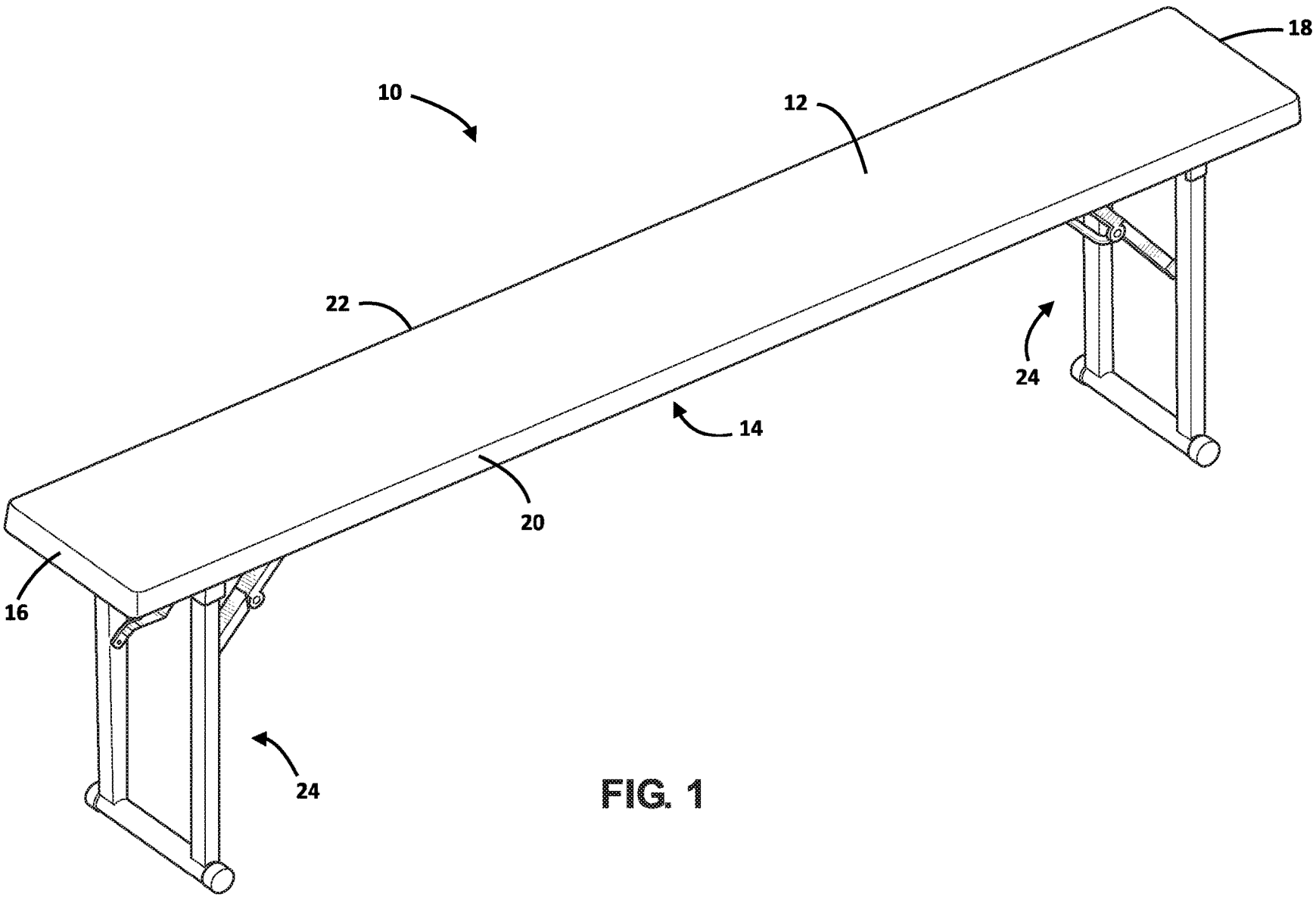
FIG. 1 is a top perspective view of a collapsible bench having identical brace members on opposing halves of the collapsible bench in an extended position according to one embodiment of the disclosure.

Referring to FIGS. 1-8, a furniture support structure 10 in accordance with one exemplary embodiment of the present disclosure includes a planar top surface 12, a bottom surface 14 opposite the top surface 12, a first end 16, a second end 18 opposite the first end 16, a first side 20, and a second side 22 opposite the first side 20. The top surface 12 is preferably rectangular shaped as shown, but may also be square, oval, circular, or irregular shaped within the spirit of the present disclosure. The top surface 12 is preferably formed from blow-molded plastic, but other materials can also be applicable. Secured to the bottom surface 14 are a plurality of folding leg assemblies 24. In preferred embodiments, the bottom surface 14 includes frame members 15, and the folding leg assemblies 24 are attached to the frame members 15 as described below.

The furniture support structure 10 of the present disclosure, and more particularly the folding leg assemblies 24 for the support structure 10, is believed to be best utilized with respect to furniture support structures having an elongated top surface 12. Even more specifically, the folding leg assemblies 24 of the present disclosure are believed to be particularly suited for structures 10 having an elongated top surface 12 that are intended to be disposed relatively low to the ground, such as the bench as shown. However, the present disclosure can also be utilized for many different structures such as tables, chairs, stools, television trays, etc. having folding leg assemblies and other folding mechanisms. Thus, while the present disclosure is shown and described herein with respect to a bench 10, it should be understood that the disclosure could also be utilized with respect to other surfaces that are supported by folding leg assemblies and other folding mechanisms.

Figure 2:
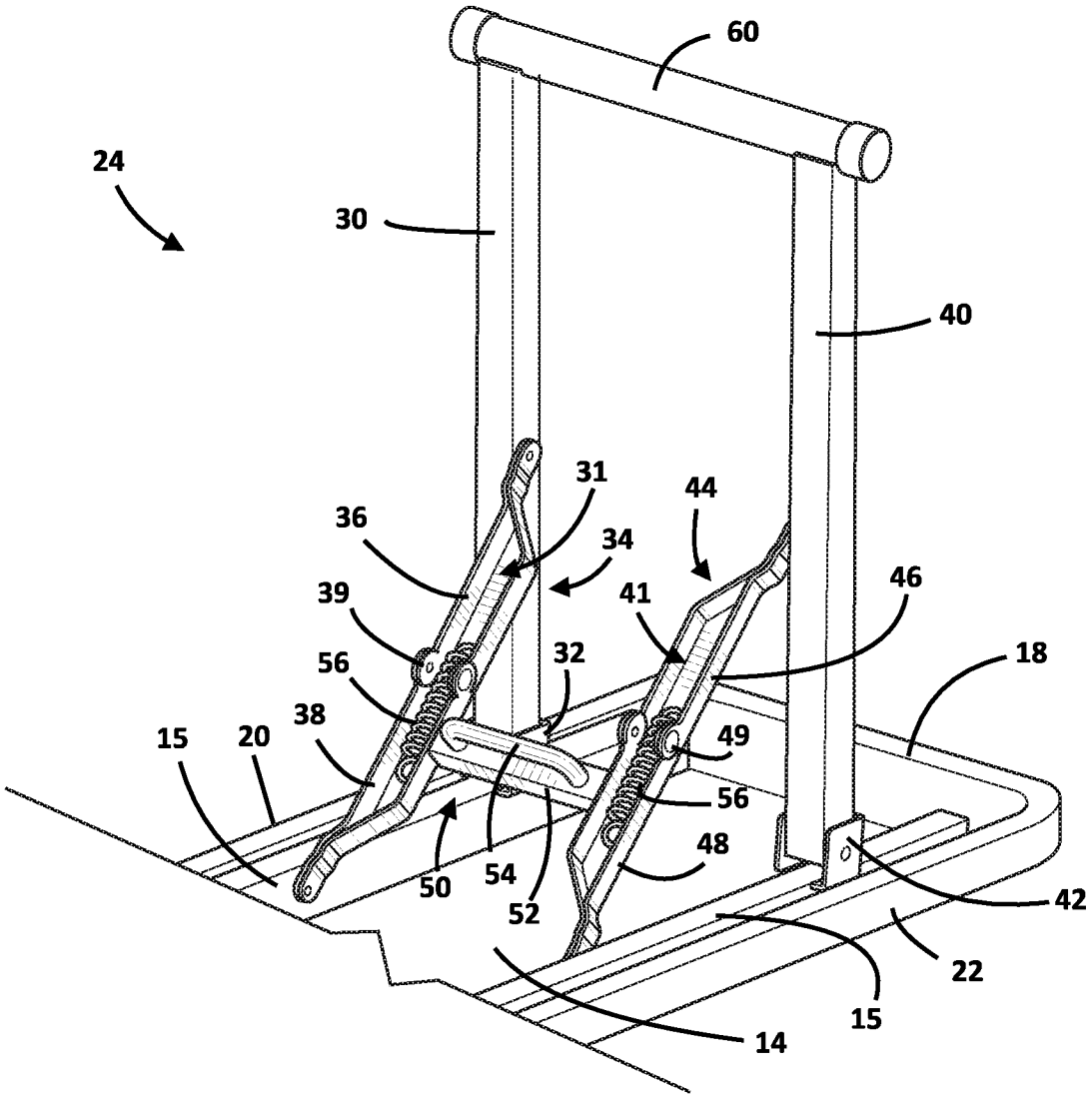
FIG. 2 is a bottom perspective view of the brace member of one half of the collapsible bench of FIG. 1 in the extended position.
Figures 3, 4:
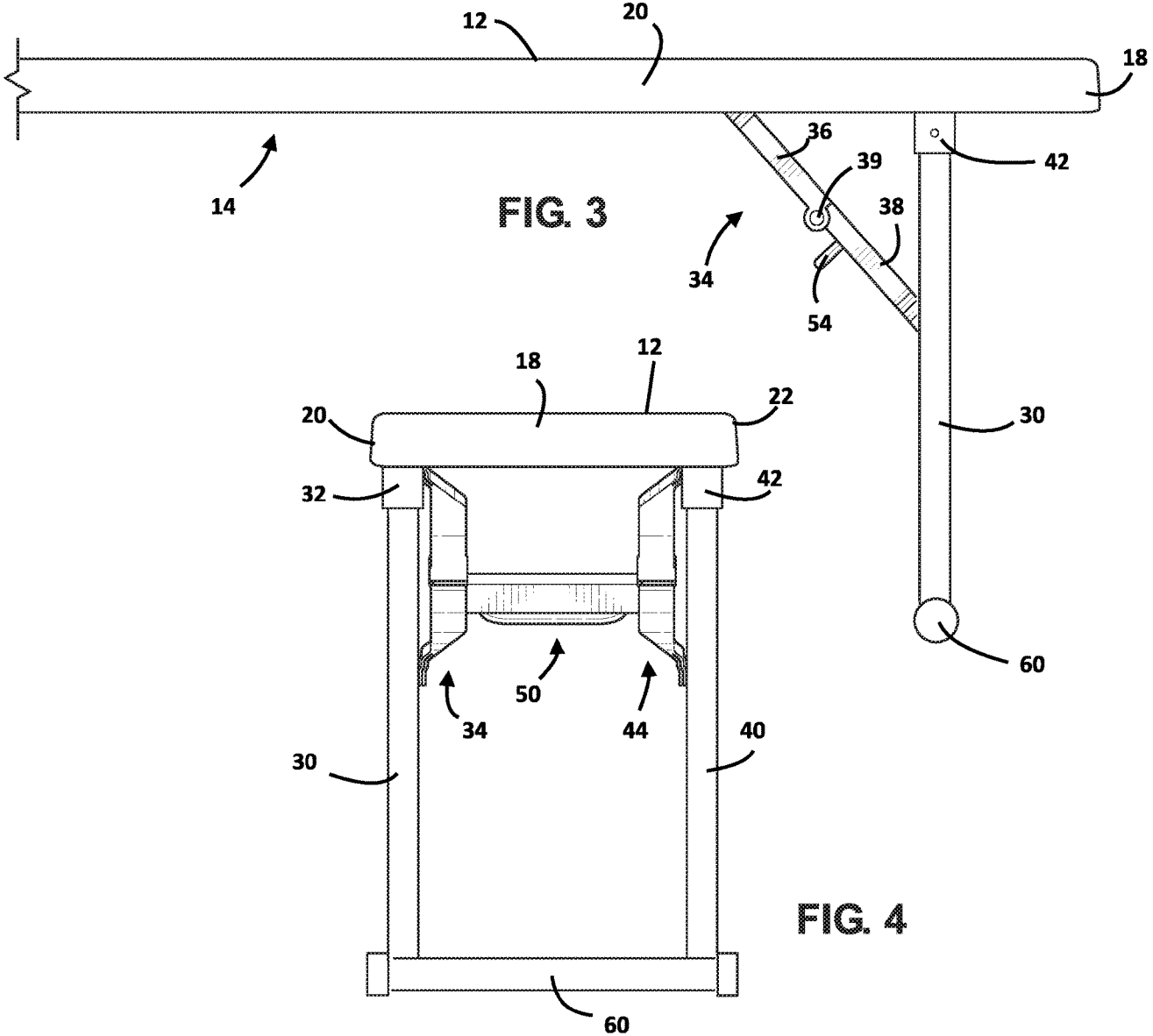
FIG. 3 is a side plan view of the brace member of FIG. 2 in the extended position.
FIG. 4 is a rear elevational view of the brace member of FIG. 2 in the extended position.

As shown best in FIG. 2, each folding leg assembly includes a first leg 30 and a second leg 40. Each leg is attached to an axle 32, 42 that is rotatably secured to a frame member 15 extending along the length of the bottom surface 14. As shown, each leg may be secured to a separate axle 32, 42. However, according to alternate embodiments, first leg 30 and second leg 40 may be secured to a single axle extending along the width of the bottom surface 14. As shown, a support member or pedestal 60 is preferably provided for securing the first leg 30 to the second leg 40 and providing additional support when the support structure 10 is in a use position.

Figure 6:
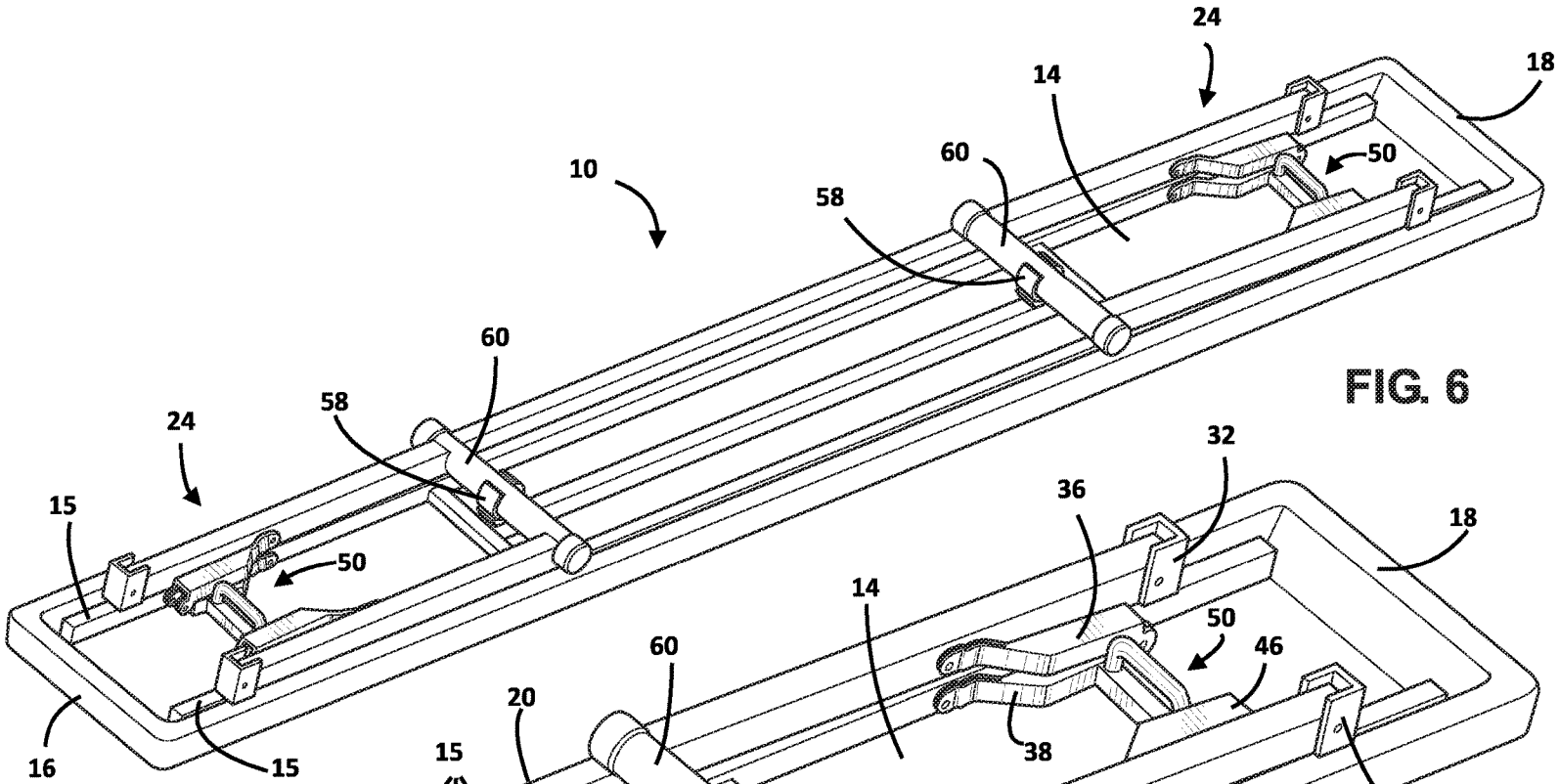
FIG. 6 is a bottom perspective view of the collapsible bench of FIG. 1 in the collapsed position.
Figure 7:
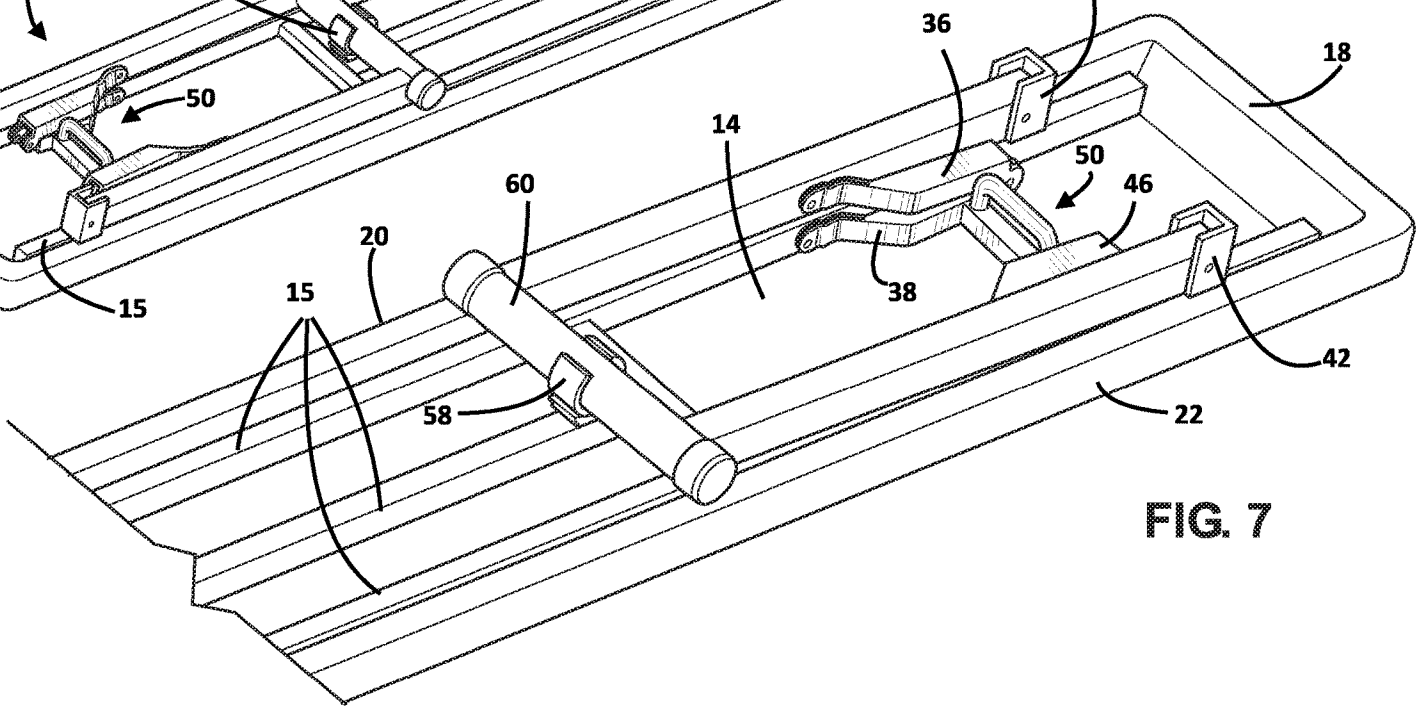
FIG. 7 is a bottom perspective view of the brace member of FIG. 2 in the collapsed position.
Figure 8:
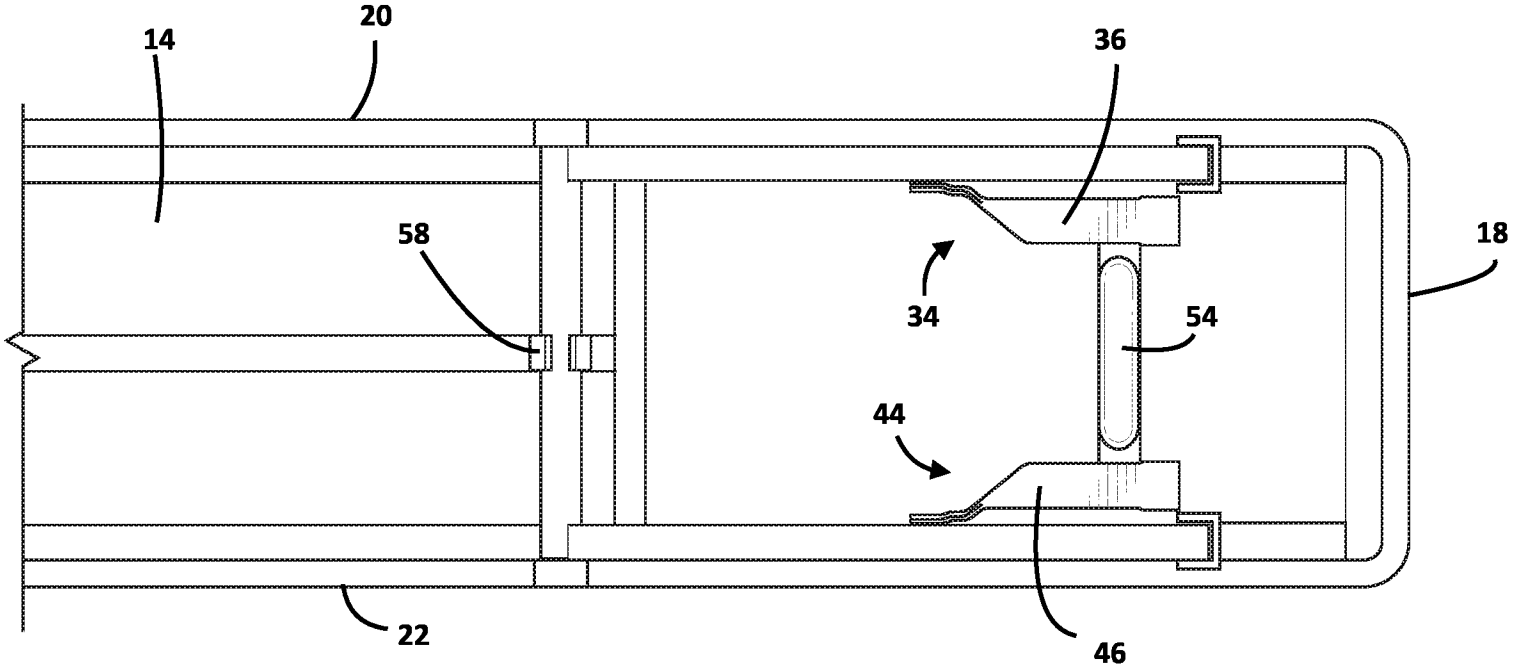
FIG. 8 is a bottom plan view of the brace member of FIG. 2 in the collapsed position.

Secured to the first leg 30 is a first brace member 34 and secured to the second leg 40 is a second brace member 44. Each brace member 34, 44 includes an upper portion 36, 46 and a lower portion 38, 48. The upper portion 36, 46 of each brace member 34, 44 is secured to their respective leg, and the lower portions 38, 48 are secured to the frame members 15 extending along the length of the bottom surface 14. Each brace member 34, 44 further includes a pivot member 39, 49 for connecting the upper portion 36, 46 to the lower portion 38, 48 such that each brace member 34, 44 is movable between an extended position and a collapsed position. Axles 32, 42 allow the legs 30, 40 to pivot when the brace members 34, 44 are moved between the extended position and the collapsed position so that the legs are movable between a use position (FIGS. 1-5) and a folded position (FIGS. 6-8).

A handle 50 is preferably disposed between the first brace member 34 and the second brace member 44 for manipulating the pivot members 39, 49 of the first and second brace members. As a result of the handle 50 connecting the pivot members 39, 49, both brace members 34 and 44 are operable to be manipulated between the extended position and the collapsed position together (i.e., the pivot members 39, 49 are concurrently manipulated using handle 50). In preferred embodiments, the handle 50 includes a cross member 52 having a first end secured to the first brace member 34 and a second end secured to the second brace member 44 and a handle portion 54 extending from the cross member 52 to make it easy for a user to grasp handle 50 using handle portion 54. In preferred embodiments, cross member 52 is welded on opposing ends to the brace members 34 and 44.

Referring to FIGS. 1-5, the first and second legs 30, 40 of each folding leg assembly 24 are in a use position when the first and second brace members 34, 44 are in the extended position. According to preferred embodiments, the handle portion 54 is dimensioned and configured to extend in the opposite direction of the first and second legs 30 and 40 (i.e., extend away from the legs) for easier access to the handle portion while the support structure 10 is in the use position. Referring to FIGS. 6-8, the first and second legs 30, 40 are in a folded position when the first and second brace members 34, 44 are in the collapsed position. When the first and second legs 30, 40 are in the folded position, the handle portion 54 is preferably dimensioned and configured to extend substantially perpendicular to the bottom surface 14 to assist in carrying the support structure 10.

Figure 5:
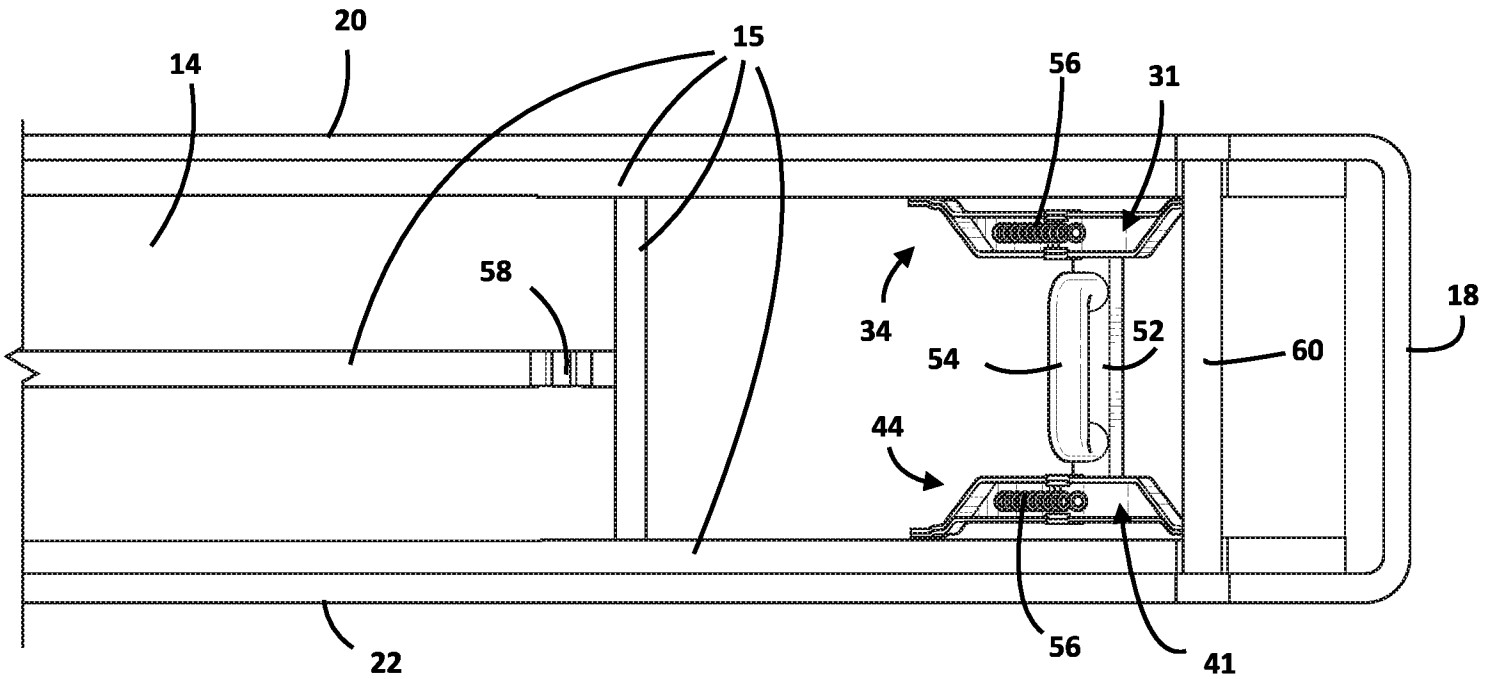
FIG. 5 is a bottom plan view of the brace member of FIG. 2 in the extended position.

Referring to FIGS. 2 and 5, each brace member 34, 44 preferably includes a spring 56 or similar extendable mechanism attached to the upper portions 36, 46 and lower portions 38, 48 of each of the first and second brace members 34, 44 for biasing the respective brace member to the extended position. In preferred embodiments, the upper portions 36, 46 and lower portions 38, 48 form recesses 31, 41 across the pivot members 39, 49, and the springs 56 or similar extendable mechanisms are disposed within the recesses 31, 41.

Referring to FIGS. 5-7, the support structure 10 preferably includes one or more clips 58 secured adjacent the bottom surface 14 for receiving the first and second legs 30, 40 in the folded position. As shown, clips 58 are preferably positioned to receive the first and second legs 30, 40 via pedestal 60. Thus, according to this embodiment, one clip 58 may be used to secure both the first and second legs 30, 40 of a folding leg assembly 24 adjacent to the bottom surface 14 of the structure 10 in the folded position by being positioned to receive the pedestal 60 (or other type of support member) connecting the first and second legs 30, 40. Additional clips 58 may be used to assist in securing the legs 30, 40 adjacent to the bottom surface 14 of the support structure 10.

The foregoing description of preferred embodiments for this disclosure has been presented for purposes of illustration and description. It is not intended to be exhaustive or to limit the disclosure to the precise form disclosed. Obvious modifications or variations are possible in light of the above teachings. The embodiments are chosen and described in an effort to provide the best illustrations of the principles of the disclosure and its practical application, and to thereby enable one of ordinary skill in the art to utilize the disclosure in various embodiments and with various modifications as are suited to the particular use contemplated. All such modifications and variations are within the scope of the disclosure as determined by the appended claims when interpreted in accordance with the breadth to which they are fairly, legally, and equitably entitled.

What is claimed is:

1. A folding leg assembly comprising:

a first leg and a second leg attached to one or more axles that are rotatably secured adjacent a bottom of a furniture support structure;

a first brace member including a first portion having a proximal end and a distal end and a second portion having a proximal end and a distal end, the proximal end of the first portion rotatably secured adjacent the bottom of the furniture support structure, the distal end of the first portion rotatably secured to the proximal end of the second portion, and the distal end of the second portion disposed between the first and second legs and rotatably secured to the first leg, wherein a first pivot member provides a rotational connection between the distal end of the first portion and the proximal end of the second portion of the first brace member;

a second brace member including a first portion having a proximal end and a distal end and a second portion having a proximal end and a distal end, the proximal end of the first portion rotatably secured adjacent the bottom of the furniture support structure, the distal end of the first portion rotatably secured to the proximal end of the second portion, and the distal end of the second portion disposed between the first and second legs and rotatably secured to the second leg, wherein a second pivot member provides a rotational connection between the distal end of the first portion and the proximal end of the second portion of the second brace member;

wherein the first pivot member and the second pivot member define a rotational axis about which the first and second portions of the first and second brace members rotate with respect to each other as the first and second brace members move together between an extended position in which the first and second legs are in a use position and a collapsed position in which the first and second legs are in a folded position, and a handle including:

a cross member for connecting the first brace member to the second brace member, the cross member having:

a first end fixedly secured to and terminating in the first portion of the first brace member at a position between the rotational axis and the proximal end of the first portion of the first brace member; and a second end fixedly secured to and terminating in the first portion of the second brace member at a position between the rotational axis and the proximal end of the first portion of the second brace member; and a handle portion fixedly secured to the cross member, the handle portion extending out from the cross member to provide spacing between the cross member and the handle portion such that the handle portion is positioned and configured for assisting in manipulating the first and second brace members from the extended position to the collapsed position and for assisting in carrying the furniture support structure when the first and second brace members are in the collapsed position.

2. The folding leg assembly of claim 1, wherein the handle portion includes at least a first member and a second member, the first member extends perpendicularly from the cross member and the second member is parallel to the cross member.

3. The folding leg assembly of claim 1 further comprising a spring attached to the first and second portions of each of the first and second brace members for biasing the respective brace member to the extended position.

4. The folding leg assembly of claim 3 wherein the first and second portions of each of the first and second brace members define a recess adjacent the first and second pivot members, and the springs are disposed within the recesses.

5. The folding leg assembly of claim 1 further comprising one or more clips secured adjacent the bottom of the furniture support structure for securing the first and second legs adjacent the bottom of the furniture support structure in the folded position.

6. The folding leg assembly of claim 1 wherein the first and second legs each include a support member connecting the first and second legs together, the folding leg assembly further comprising at least one clip positioned adjacent the bottom surface of the support structure to receive the support member when the first and second legs are in the folded position.

7. The folding leg assembly of claim 1 wherein, when the first and second brace members are in the collapsed position, the first portions of the first and second brace members extend along the bottom of the furniture support structure, the second portions of the first and second brace members are folded over the corresponding first portions, and the handle is positioned and configured to extend in a direction away from the bottom of the furniture support structure.

8. The folding leg assembly of claim 7 wherein, when the first and second brace members are in the extended position, the first and second portions of the first and second brace members are linearly aligned and the handle is positioned and configured to extend in the direction away from the bottom of the furniture support structure.

9. The collapsible furniture support structure of claim 7 wherein the first and second legs include a first support member connecting the first and second legs together and the third and fourth legs include a second support member connecting the third and fourth legs together, the support structure further comprising at least a first clip positioned adjacent the bottom surface of the supporting structure to receive the first support member when the first and second legs are in the folded position and a second clip positioned adjacent the bottom surface of the supporting structure to receive the second support member when the third and fourth legs are in the folded position.

10. A folding leg assembly comprising:

a first frame member and an opposing second frame member attached adjacent a bottom of the furniture support structure;

a first leg rotatably secured to the first frame member;

a second leg rotatably secured to the second frame member;

a first brace member including a first portion having a proximal end and a distal end and a second portion having a proximal end and a distal end, the proximal end of the first portion disposed between the first and second frame members and rotatably secured to the first frame member, the distal end of the first portion rotatably secured to the proximal end of the second portion, and the distal end of the second portion disposed between the first and second legs and rotatably secured to the first leg, wherein a first pivot member provides a rotational connection between the distal end of the first portion and the proximal end of the second portion of the first brace member;

a second brace member including a first portion having a proximal end and a distal end and a second portion having a proximal end and a distal end, the proximal end of the first portion disposed between the first and second frame members and rotatably secured to the second frame member, the distal end of the first portion rotatably secured to the proximal end of the second portion, and the distal end of the second portion disposed between the first and second leg members and rotatably secured to the second leg, wherein a second pivot member provides a rotational connection between the distal end of the first portion and the proximal end of the second portion of the second brace member;

wherein the first pivot member and the second pivot member define a rotational axis about which the first and second portions of the first and second brace members rotate with respect to each other as the first and second brace members move together between an extended position in which the first and second legs are in a use position and a collapsed position in which the first and second legs are in a folded position, and a handle including:

a cross member for connecting the first brace member to the second brace member, the cross member having:

a first end fixedly secured to and terminating in the first portion of the first brace member at a position between the rotational axis and the proximal end of the first portion of the first brace member; and a second end fixedly secured to and terminating in the first portion of the second brace member at a position between the rotational axis and the proximal end of the first portion of the second brace member; and a handle portion fixedly secured to the cross member, the handle portion extending out from the cross member to provide spacing between the cross member and the handle portion such that the handle portion is positioned and configured for assisting in manipulating the first and second brace members from the extended position to the collapsed position and for assisting in carrying the furniture support structure when the first and second brace members are in the collapsed position, wherein when the first and second brace members are in the collapsed position, the first portions of the first and second brace members extend along the bottom of the furniture support structure and are disposed between and aligned with the first and second frame members, the second portions of the first and second brace members are folded over the corresponding first portions and are disposed between and aligned with the first and second leg members, and the handle portion is positioned and configured with respect to the cross member in a direction away from the bottom of the furniture support structure, and wherein when the first and second brace members are in the extended position, the first and second portions of the first and second brace members are linearly aligned and the handle portion is positioned and configured with respect to the cross member in the direction away from the bottom of the furniture support structure.

* * * * *